United States Patent [19]

Koteles

[11] Patent Number: 4,897,155

[45] Date of Patent: Jan. 30, 1990

[54] METHOD FOR PRODUCING LOW FINES CONTENT PULP BY SUBJECTING CELLULOSIC CHIPS TO LOW FREQUENCY COMPRESSION-RELAXATION CYCLES

[75] Inventor: Rudy J. Koteles, Glens Falls, N.Y.

[73] Assignee: Kamyr, Inc., Glens Falls, N.Y.

[21] Appl. No.: 54,491

[22] Filed: May 27, 1987

[51] Int. Cl.[4] ..... D21B 1/16; D21C 3/26; D21C 9/10

[52] U.S. Cl. ..... 162/18; 162/19; 162/26; 162/28; 162/83; 162/86

[58] Field of Search ..... 162/18, 19, 25, 26, 162/28, 61, 238, 49

[56] References Cited

U.S. PATENT DOCUMENTS

| | | | |
|---|---|---|---|
| 2,673,690 | 3/1954 | Segl | 162/18 |
| 4,088,528 | 5/1978 | Berger et al. | 162/19 |
| 4,160,693 | 7/1979 | Lindahl et al. | 162/25 |
| 4,214,947 | 7/1980 | Berger | 162/19 |
| 4,294,653 | 10/1981 | Lindahl et al. | 162/25 |
| 4,554,051 | 11/1985 | Danfonth | 162/254 |
| 4,692,210 | 9/1987 | Forrester | 162/254 |

OTHER PUBLICATIONS

Collicutt et al., "Developments in Mechanical Pulping", *TAPPI*, Jun. 1981, vol. 64, No. 6.

*Primary Examiner*—Steve Alvo

*Attorney, Agent, or Firm*—Nixon & Vanderhye

[57] ABSTRACT

A method for producing low fines content pulp having successive treatment stages in each of which compressive and shearing forces are applied to the cellulosic fiber while simultaneously one or more chemicals are added. Gradual breakdown of the fibers is achieved with resulting low fines production whereby the pulp may be used for tissue, fluff and towel products.

13 Claims, 2 Drawing Sheets

METHOD FOR PRODUCING LOW FINES CONTENT PULP BY SUBJECTING CELLULOSIC CHIPS TO LOW FREQUENCY COMPRESSION-RELAXATION CYCLES

BACKGROUND AND SUMMARY OF THE INVENTION

The present invention relates to methods of treatment of cellulosic fibers and particularly to methods for producing low fines content pulp for use in tissue, fluff and towel products.

Known methods of mechanical defibration of wood chips, impregnated or not, such as disc or grindstone defibration, produce substantial quantities of fines. High levels of fines, however, are detrimental to many products, such as tissue, fluff and towel products, because they cause dusting, drainage problems on the paper making machinery, poor fiber retention and decreased softness in the resulting product. Short fibers in the pulp for use in these products are also not desired.

Cellulosic fibers are sometimes treated in an apparatus comprising a pair of intermeshing screws in a treatment housing in communication at one end with an inlet for receiving the cellulosic fibers and at its opposite end with an outlet for the treated fibers. The screws counter-rotate in the area where the flights of the screws intermesh and that area constitutes a treatment zone. Treatment is conducted under compression and shear. This generally provides pulps having certain beneficial advantages. Such apparatus is commercially available under the trademark Frotapulper ®.

Methods of treating pulp using that apparatus have been effective in modifying pulp fibers by the application of compressive and shear forces on the pulp at high consistencies and high temperature. For example, with respect to kraft and sulfite pulps, this treatment results in a reduction in tensile strength, water retention value and swollen volume. Porosity, stretch and tear strength are increased. Rejects from chemical pulps may also be defibered using the foregoing described apparatus. Additionally, such apparatus has been used to disperse waste paper contaminants and modify the physical properties of such waste paper. In that connection, the apparatus defibers waste without producing substantial fines. Other uses of the foregoing apparatus have included removal of resin from pulps, the mixing of chemicals in pulp, defibration of flax, and defibration and development of properties of semi-chemical and chemimechanical pulps.

According to the present invention, there is provided a method for producing low fines content pulp for use in producing tissue, fluff and towel products. For purposes of this application, low fines content pulp may be defined as a pulp containing about 10% fines or less. To accomplish the foregoing, cellulosic fibrous chips are conventionally washed and squeezed to reduce their moisture content. The fiber material is then sequentially subjected to compressive and shearing forces while being impregnated with chemicals. For example, to form high freeness fluff, the washed and squeezed cellulosic fibers are refined by subjecting them to compressive and shearing forces at the same time a chemical, for example a mixture of sodium sulfite and DTPA, is added to the fiber. This compressive and shearing action may be characterized by low frequency high amplitude compression-relaxation cycles affording high energy transfer into the pulp at a low rate. After a certain residence time in a reaction chamber, the fibers are once again subjected to compressive and shearing forces of the same character and additional chemical, for example caustic, is added whereby the fibers are further softened. The fibers are subsequently subjected to additional compressive and shearing forces of like character in further similar stages of treatment while chemicals, such as bleaching agents, may be added until this controlled defibration produces a high freeness fluff with very few fines. Also, the treatment with the bleaching agent brightens the fibers. Thus, by sequentially subjecting the fibers in different treatment stages to compressive and shearing forces of this type while adding the appropriate chemicals, the fibers are gradually broken down without producing substantial fines. Rejects from the sequential treatment stages can be recycled back to previous treatment stages for further defibration and treatment.

Accordingly, it is a primary object of the present invention to provide a novel and improved method for producing low fines content pulp for use in tissue, fluff and towel products.

These and further objects and advantages of the present invention will become more apparent upon reference to the following specification, appended claims and drawings.

DETAILED DESCRIPTION OF THE INVENTION

Figure 1:
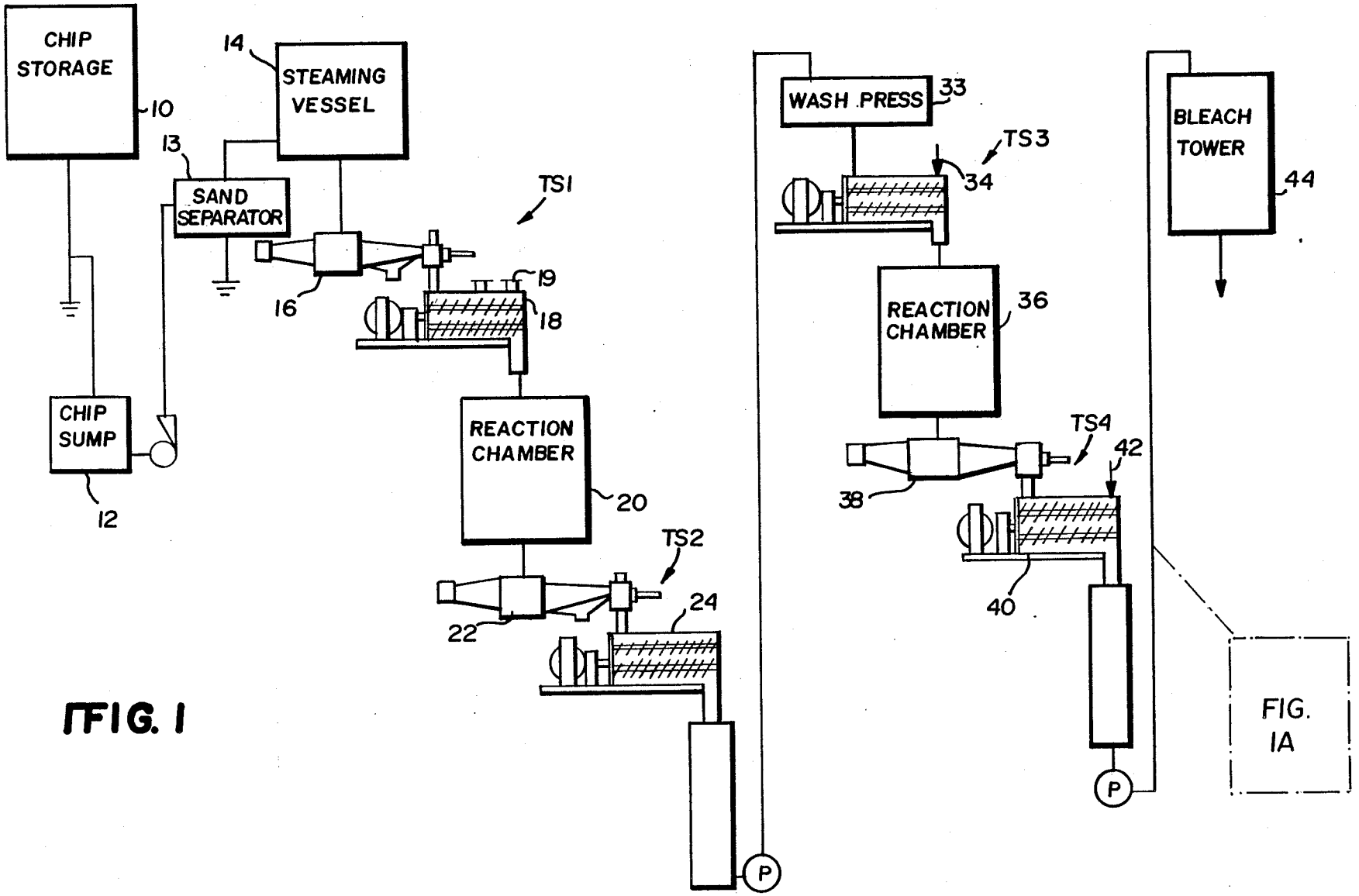
FIG. 1 is a schematic illustration of a process for producing low fines content pulp according to the present invention.

Referring now to the drawing, cellulosic chips are initially stored in a chamber 10 where they are prepared for further processing by washing. The washed chips are transferred through a chip sump 12 and said separator 13 for disposition in a steaming vessel 14. From the steaming vessel 14, the chips flow to a first treatment stage, generally designated TS1. At this first treatment stage, the washed and steamed chips flow through a plug screw feeder 16 which reduces the moisture content and removes or reduces the concentration of other soluble material from the chips. The chips are then fed to a defibrating apparatus 18 wherein compressive and shear forces are applied to the chips, while simultaneously a chemical or combination of chemicals is added to the chips. The apparatus preferably comprises the commercially available processing apparatus sold under the trademark Frotapulper ®. Such apparatus includes counter-rotating screws, the intersection of the flights of which defines a treatment zone in which compressive and shearing forces are applied to the chips or fiber disposed therebetween. At this stage, the chips are impregnated with one or more chemicals, such as sodium sulfite, DTPA, or other chemicals such as caustic and/or bleaching agents, and which chemicals are added directly to the material in the defibrating apparatus through one or more inlets 19. In addition to the chemical impregnation, there is also provided in the defibrating apparatus a breakdown of the chips wherein the chips are converted to fibers with reduced production of fines.

From this treatment stage TS1, the fibers are disposed in a reaction chamber 20 for a predetermined time interval. The time and temperature in reaction chamber 20 helps to determine and control the fiber length distribution. Fiber length is also determined and controlled by the action of the compressive and shearing forces in the first treatment stage TS1.

From reaction chamber 20, the fibers are subjected to a second stage of treatment indicated TS2. The fibers from reaction chamber 20 are first fed through a plug screw feeder 22 which, similarly as described above, reduces the moisture content of the fiber and removes soluble material. From the feeder, the fibers are fed to a second defibrating apparatus 24, that is, apparatus sold under the trademark Frotapulper®. In this apparatus 24, compressive and shearing forces are applied to the fibers at the same time the fibers are impregnated, for example, with caustic, supplied through an inlet 26.

The fibers from the second stage treatment are fed to a third treatment stage TS3, where the fibers are first washed, pressed and squeezed in a wash press 30 to once again reduce their moisture content and to remove or reduce soluble material content. In this stage, the washed and pressed fibers are fed to a third defibrating apparatus 32, i.e., a Frotapulper® processing apparatus, where compressive and shearing forces are applied to the fibers simultaneously with the addition of bleach, preferably peroxide bleach, supplied to the fibers through an inlet 34. The bleached fibers are then disposed in a reaction chamber 36 for a predetermined time and temperature.

The bleached fibers are then fed to a fourth treatment stage TS4, where the fibers are again squeezed in a plug screw feeder 38 to reduce their moisture content and reduce or remove soluble material content. The fibers are then once again subjected to compressive and shearing forces in a fourth defibrating apparatus 40, i.e., a Frotapulper® processing apparatus, in which the fibers are simultaneously impregnated with a bleach, preferably peroxide bleach, supplied through inlet 42. The bleached fibers from the fourth treatment stage TS4 constitute pulp, which has very low fines content. Thus, there is provided a multi-stage, gentle, continuing separation of fibers. This results in low fines content pulp, 10% or less, with good paper making properties. This pulp is then transmitted to a bleach tower 44. It will be appreciated that rejects from the various treatment stages, as well as the chemicals removed from the fibers in those stages, are recycled back for further use in prior treatment stages. Additional similar treatment stages may be provided as desired depending upon the requirements for the final pulp product.

Figure 1A:
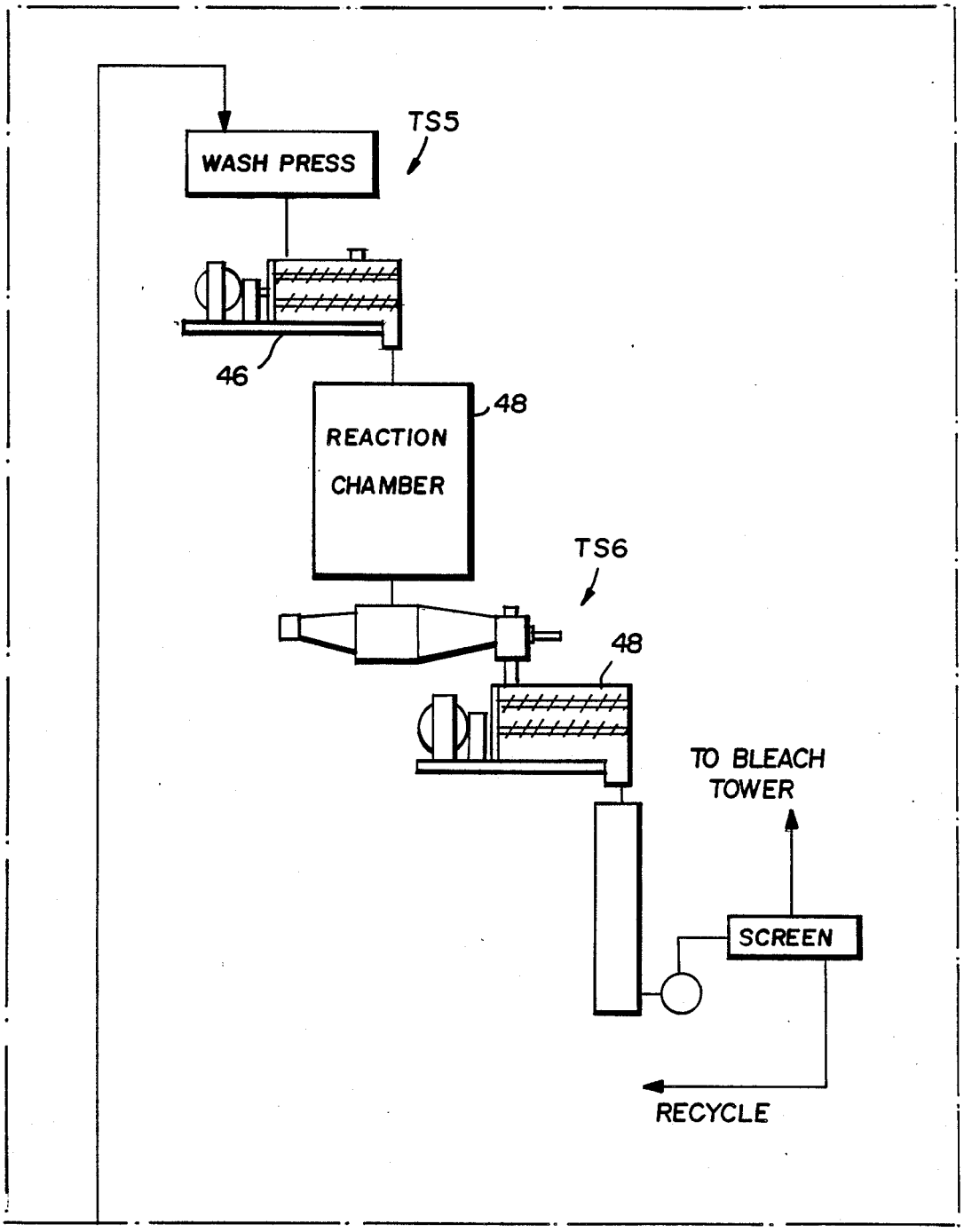
FIG. 1A is a schematic illustration of additional apparatus useful for providing pulp with particularly low freeness grades, such additional apparatus being located in the apparatus of FIG. 1 as indicated by the FIG. 1A in FIG. 1.

The process may be continued further to produce pulp having lower freeness grades, for example down to 300 CSF, for tissue and towel products. To accomplish this, additional similar treatment stages are provided intermediate treatment stage TS4 and the bleach tower 44 as indicated in FIG. 1A. These additional treatment stages use additional processing apparatus, preferably a Frotapulper® processing apparatus, for sequentially compressing and shearing the fibers in conjunction with chemical additives. For example, the pulp produced from the fourth treatment stage TS4 may be washed and pressed and subsequently, in a fifth treatment stage TS5, provided with a fifth processing apparatus 46 for further compressive and shearing action. Suitable chemicals may be added or not at this processing stage. The fibers resulting from that action are transported to a reaction chamber 48 for retention over a suitable time interval. The fibers are then transported to a sixth treatment stage TS6, wherein the fibers are again squeezed and pressed to reduce their moisture content and disposed in a defibrator 48, i.e., a Frotapulper® processing apparatus, for further compression and shearing action. The resulting fibers may then be screened to recycle the shives and this low freeness grade fiber may then be disposed in the bleach tower 44 for subsequent processing as indicated previously.

Soluble hemicelluloses may be removed during this process. Thus, the normal leaching out of these hemicelluloses from the pulp over periods of time which cause adhesion problems in the manufacture of tissue is reduced in the formation of the tissue pulp.

It will be appreciated that the defibrating apparatus used in the present invention affords a different kind of action in comparison with the action in more conventional refiners, such as disc or conical refiners. Particularly, the frequency and amplitude of the compression-relaxation cycles are different, resulting in a different type of breakdown of the wood fibers. For example, in disc refiners, there are a very large number of compression-relaxation cycles per minute, on the order of about 200 million for a standard fifty-four inch disc refiner. On the other hand, the defibrating apparatus used in the present invention has a much lower number of compression-relaxation cycles per minute, on the order of about ninty-seven thousand. The relative frequency of compression cycles per minute in comparing a standard 54-inch disc refiner with a Frotapulper® refiner is therefore about 2000/1. Thus, the conventional disc refiners may be characterized as having high frequency, low amplitude compression-relaxation cycles affording low energy transfer into the pulp at a high rate. The refining apparatus used in the present invention provides low frequency, high amplitude compression-relaxation cycles affording high energy transfer into the pulp at a low rate. The duration of the compression-relaxation cycle in the refining apparatus hereof is also longer in comparison with the standard disc refiner. Consequently, it will be appreciated that the combination of (1) thorough impregnation of chemical additions caused by Frotapulper® treatment of wood (the compression-relaxation cycles cause the chemical addition to move into the wood substance); (2) the difference in rate of energy transfer associated with lower frequency, longer duration compression-relaxation cycles in comparison with standard disc refiners; and (3) the reduction in internal bonding of the wood (a softening effect) as a result of the presence of a chemical produces a long fiber, low fines content pulp.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method for producing a pulp having a low fines content of 10% or less comprising the steps of:

(a) subjecting cellulosic fibrous chips in a first treatment stage to compressive and shearing forces characterized by low frequency compression-relaxation cycles to convert the chips to fibers;

(b) impregnating the chips with a chemical while simultaneously subjecting the chips to said compressive and shearing forces;

(c) controlling the distribution of the fiber length by retaining the fibers resulting from step (b) in a reaction chamber for a predetermined time at a predetermined temperature to control the fiber length distribution;

(d) squeezing the fibers to reduce their moisture content;

(e) subjecting the fibers in a second treatment stage to compressive and shearing forces characterized by low frequency compression-relaxation cycles;

(f) impregnating the fibers with a chemical, while simultaneously subjecting the fibers to the compressive and shearing forces of step (e); and (g) bleaching the fibers resulting from step (f), wherein the method steps produce a pulp having a low fines content of 10% or less.

2. A method according to claim 1 including the step of washing the fibers resultant from step (f).

3. A method according to claim 1 wherein the chemical added in step (b) is sodium sulfite.

4. A method according to claim 1 wherein the chemical added in step (b) is DTPA.

5. A method according to claim 1 wherein the chemical added in step (f) is caustic.

6. A method according to claim 1 wherein step (g) includes the step of subjecting, in a third treatment stage, the fiber resulting from step (f) to compressive and shearing forces while simultaneously impregnating such fiber with a bleaching agent.

7. A method according to claim 6 including the step of squeezing the bleached fibers to reduce their moisture content, subjecting in a fourth treatment stage, the squeezed bleached fiber to compressive and shearing forces characterized by low frequency compression-relaxation cycles while simultaneously impregnating such fibers with a bleaching agent.

8. A method according to claim 7 including the step of transmitting the bleached fibers resulting from the second bleaching agent impregnation to a bleach tower.

9. A method according to claim 1 for producing low fines tissue pulp including the further steps of:

subjecting, in a third treatment stage, the fibers resulting from step (f) to compressive and shearing forces characterized by low frequency compression-relaxation cycles and impregnating the fibers in the third treatment stage with a chemical while simultaneously subjecting the fibers to compressive and shearing forces;

subjecting in a fourth stage the fibers resulting from the third stage to compressive and shearing forces characterized by low frequency compression-relaxation cycles and impregnating the fibers in the fourth stage with a chemical, while simultaneously subjecting chips to compressive and shearing forces;

(h) subjecting, in a fifth treatment stage, the bleached fibers resulting from step (g) to compressive and shearing forces characterized by low frequency compression-relaxation cycles to further defiber the bleached fiber;

(i) controlling the distribution of the fiber length by retaining the bleached fibers resultant from step (h) in a reaction chamber for a predetermined time at a predetermined temperature; and (j) subjecting, in a sixth treatment stage, the bleached fibers resulting from step i to compressive and shearing forces characterized by low frequency compression-relaxation cycles to further defiber the bleached fiber.

10. A method according to claim 9 including the step of transmitting the bleached fibers resulting from step (j) to a bleach tower.

11. A method according to claim 9 including, in each of steps (h) and (j), the steps of impregnating the fibers with a bleaching agent while the fibers are subjected to the compressive and shearing forces.

12. A method according to claim 9 including, between steps (i) and (j), squeezing the bleached fibers to reduce the moisture content.

13. A method according to claim 9 including the step of recycling rejects from fibers resulting from one of steps (f), (h) or (j) to a prior treatment stage.

* * * * *